US011203461B2

(12) United States Patent
Langenbeck

(10) Patent No.: US 11,203,461 B2
(45) Date of Patent: Dec. 21, 2021

(54) WOOD LUMBER REPLACEMENT TECHNOLOGY

(71) Applicant: Keith A. Langenbeck, Keller, TX (US)

(72) Inventor: Keith A. Langenbeck, Keller, TX (US)

( * ) Notice: Subject to any disclaimer, the term of this patent is extended or adjusted under 35 U.S.C. 154(b) by 0 days.

(21) Appl. No.: 16/932,752

(22) Filed: Jul. 18, 2020

(65) Prior Publication Data

US 2021/0024250 A1 Jan. 28, 2021

Related U.S. Application Data

(60) Provisional application No. 62/877,398, filed on Jul. 23, 2019.

(51) Int. Cl.

| | |
|---|---|
| ***B65D 19/00*** | (2006.01) |
| *E04H 17/14* | (2006.01) |
| *E04C 3/28* | (2006.01) |

(52) U.S. Cl.

CPC ..... *B65D 19/0095* (2013.01); *B65D 2519/00044* (2013.01); *B65D 2519/00079* (2013.01); *B65D 2519/00273* (2013.01); *B65D 2519/00293* (2013.01); *B65D 2519/00323* (2013.01); *B65D 2519/00333* (2013.01); *B65D 2519/00572* (2013.01); *E04C 3/28* (2013.01); *E04H 17/1413* (2013.01)

(58) Field of Classification Search

CPC ..... B65D 19/0095; B65D 2519/00273; B65D 2519/00293; B65D 2519/00323; B65D 2519/00333; B65D 2519/00572

USPC ..... 108/57.25, 56.1, 56.3, 57.17, 57.19

See application file for complete search history.

(56) References Cited

U.S. PATENT DOCUMENTS

| | | | | | |
|---|---|---|---|---|---|
| 2,699,912 | A * | 1/1955 | Cushman | B65D 19/0012 | 108/56.1 |
| 3,878,796 | A * | 4/1975 | Morrison | B65D 19/0075 | 108/56.1 |
| 4,220,099 | A * | 9/1980 | Marchesano | B65D 19/0069 | 108/57.1 |
| 5,337,681 | A * | 8/1994 | Schrage | B65D 19/0071 | 108/56.1 |
| 5,417,167 | A * | 5/1995 | Sadr | B65D 19/0093 | 108/57.19 |
| 5,458,069 | A * | 10/1995 | Stolzman | B29C 65/561 | 108/56.3 |
| 5,579,701 | A * | 12/1996 | Wah | B65D 19/0069 | 108/56.1 |

(Continued)

*Primary Examiner* — Jose V Chen

(74) *Attorney, Agent, or Firm* — Lyman Moulton, Esq.; Moulton Patents, PLLC

(57) ABSTRACT

A stringer and plank pallet, system and method includes a plurality of planks made of a composite material or a non-wood material and a thickness and holes defined therein comprising a plurality of post cutouts in each of a first and a second end of the plurality of planks. A plurality of stringers made of the composite or non-wood material are configured to receive the plurality of planks via a plurality of post plugs equivalent to the plank thickness and complementary to the plurality of post cutouts. An assembled outside surface relation of the plurality of stringers to the plurality of planks is self-aligning and flush. A plurality of holes are defined in the planks adjacent a first and a second end of the post cutouts to receive a plurality of fasteners driven into the plurality of stringers.

15 Claims, 14 Drawing Sheets

(56) References Cited

U.S. PATENT DOCUMENTS 5,941,179 A * 8/1999 Herring ..... B65D 19/0095 108/57.19
6,216,608 B1 * 4/2001 Woods ..... B65D 19/0012 108/56.1
7,004,083 B2 * 2/2006 Ramirez von Holle ..... B65D 19/0026 108/57.25
7,490,561 B1 * 2/2009 Chou ..... B65D 19/0095 108/56.1
7,578,244 B2 * 8/2009 Williams, Jr. ..... B65D 19/0095 108/56.3
8,087,364 B2 * 1/2012 Huang-Jung ..... F16B 5/065 108/56.3
8,627,773 B2 * 1/2014 Storteboom ..... B65D 19/38 108/51.11
9,038,547 B2 * 5/2015 Whiteford ..... B65D 19/0095 108/57.25
2004/0000259 A1 * 1/2004 Taft ..... B65D 19/0073 108/57.25
2005/0268824 A1 * 12/2005 Williams, Jr. ..... B65D 19/0095 108/57.25
2006/0230988 A1 * 10/2006 Berg ..... B65D 19/0095 108/57.25
2007/0209558 A1 * 9/2007 Isle ..... B65D 19/0095 108/57.25
2008/0236455 A1 * 10/2008 Naidu ..... F16B 21/086 108/56.1
2009/0178595 A1 * 7/2009 Chen ..... B65D 19/0097 108/57.25
2010/0107934 A1 * 5/2010 Hsieh ..... B65D 19/0095 108/53.1
2012/0132114 A1 * 5/2012 Krupka ..... B65D 19/0095 108/57.25
2013/0160680 A1 * 6/2013 Ten Bok ..... B29C 44/0407 108/50.11
2015/0274358 A1 * 10/2015 Hidalgo ..... B65D 19/0097 108/56.3
2018/0162588 A1 * 6/2018 Segerstrom ..... B65D 19/0093
2018/0215505 A1 * 8/2018 Hawley ..... B65D 19/0095
2020/0207512 A1 * 7/2020 Marconel Carpio ..... B65D 19/0093

* cited by examiner

204

WOOD LUMBER REPLACEMENT TECHNOLOGY

CROSS-REFERENCE TO RELATED APPLICATION

This application claims the benefit of the priority date of earlier filed U.S. Provisional Patent Application Ser. No. 62/877,398 titled 'Lumber Replacement Technology' filed Jul. 23, 2019 by Keith A. Langenbeck, and is incorporated herein by reference in its entirety.

BACKGROUND OF THE INVENTION

Conventional wood pallets are typically comprised of stringers and planks nailed together. In North America, wood is the predominant material used in pallets. Pallets may be treated with a preservative, then assembled with screw or nail fasteners through the plank into the stringer. The list of problems with wood pallets include splitting or cracking along the grain lines, planks coming loose or working out from stringers, insect degradation, weather degradation, leaching of toxic chemicals into the ground water and air pollution when incinerated.

Even with these operational problems, the wooden pallet still holds a dominant market share of about 90 percent in America. The remaining market share is comprised of prefabricated pallets. Wood pallets are the least expensive but have the shortest expected life cycle before needing replacement. Wood pallets are more subject to weather related degradation. In certain locations, wood pallets cannot be used due to rapid destruction from insects like termites. Wood pallets are more likely to release the nail or screw fasteners that hold the planks to the stringers and thus subject to vandalism. The toxic preservatives used to extend the life of wood pallets also leach out over time and contaminate the environment.

SUMMARY OF THE INVENTION

A wood lumber replacement technology (WLRT) stringer and plank pallet and system includes a plurality of planks made of a composite material or a non-wood material of a thickness and holes defined therein comprising a plurality of post cutouts in each of a first and a second end of the plurality of planks. A plurality of stringers made of a composite material or non-wood material are configured to receive the plurality of planks via a plurality of post plugs equivalent to the plank thickness and complementary to the plurality of post cutouts. An assembled outside surface relation of the plurality of stringers to the plurality of planks is self-aligning and flush via a machined relation. A plurality of holes are defined in the planks adjacent a first and a second end of the post cutouts to receive a plurality of fasteners driven into the plurality of stringers.

A method of making the disclosed pallet includes defining a plurality of planks comprising a composite material or a non-wood material and a thickness and holes therein comprising a plurality of post cutouts in each of a first and a second end of the plurality of planks. The disclosed method also includes defining a plurality of post plugs equivalent to the plank thickness and complementary to the plurality of post cutouts in a plurality of planks of a composite material or a non-wood material configured to receive the plurality of planks. An assembled outside surface relation of the plurality of stringers to the plurality of planks is self-aligning and flush via a machined relation.

Other aspects and advantages of embodiments of the disclosure will become apparent from the following detailed description, taken in conjunction with the accompanying drawings, illustrated by way of example of the principles of the disclosure.

Figure 1A:
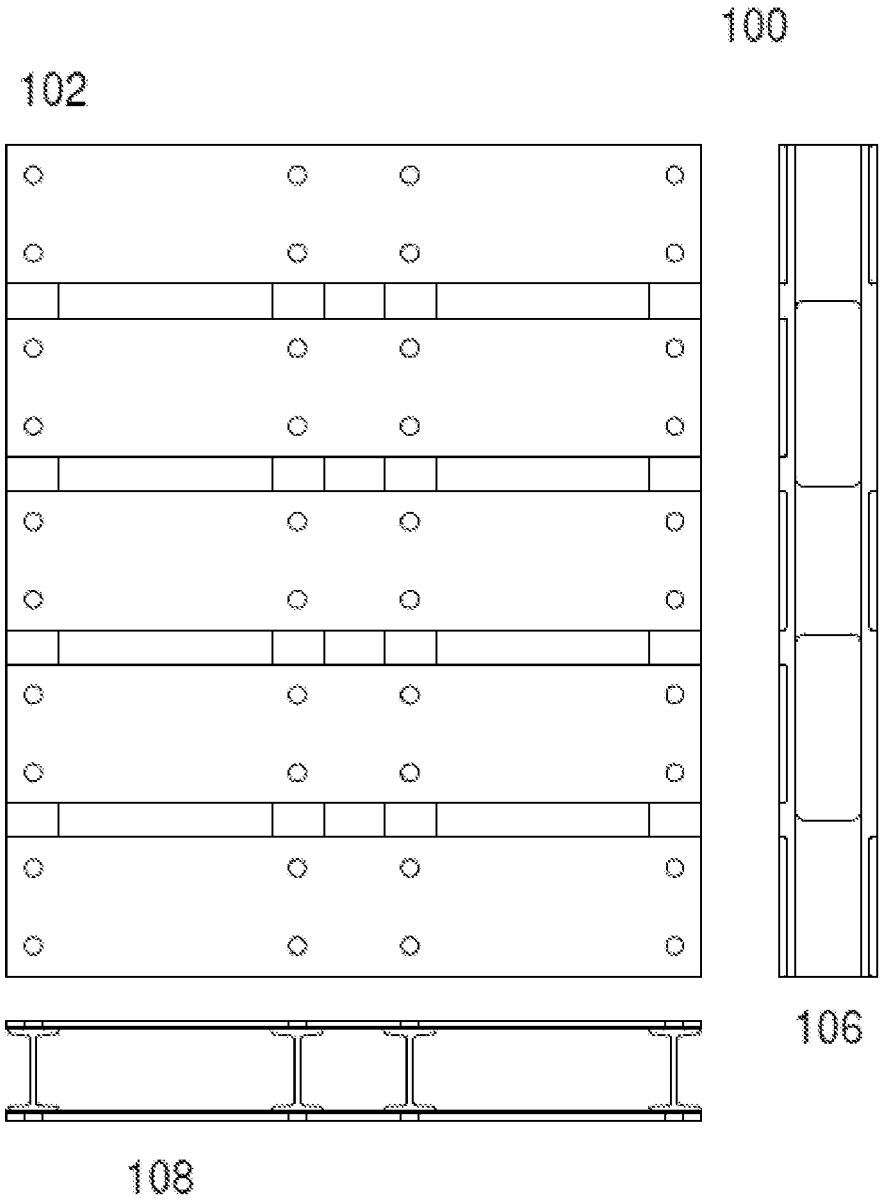
FIG. 1A depicts an example of a WLRT plank and stringer pallet employing a urethane and mineral filler composite cast or extruded into stringer blanks and plank blanks in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

This application describes and illustrates unique and affordable substitutes for common uses of soft and hard wood lumber. The term or name Wood Lumber Replacement Technology and the acronym WLRT are anticipated for use as tradenames in commercial products. The terms composite and non-wood material are used to describe an alternative material to the commonly used prevalent wood material.

A first example of the disclosed technology is a unique shipping pallet with the individual planks and stringers comprised of extruded polymer foam or mineral filled polymer composites. Engineered non-wood or composite material planks and stringers allow for shapes, sizes and material properties to be optimized for the application. The term or name Wood Lumber Replacement Technology-Pallet and the acronym WLRT-Pallet are anticipated for use as tradenames in commercial sales of pallets, irrespective of the non-wood material that is utilized.

The composite and sometimes non-wood material is homogenous, amorphous and without the grain structure of wood, thus eliminating the structural weakness of wood members that commonly fail at the growth rings or grain structure. The composite or non-wood material can be foamed to reduce the density to that of wood or less and can include reinforcement materials such as fiberglass and others.

FIG. 1A depicts an example of a WLRT the plank and stringer pallet 100 employing a urethane and mineral filler composite cast or extruded into stringer blanks 110 and plank blanks 150 in accordance with an embodiment of the present disclosure. Seen in FIG. 1 are the top view 102 of pallet 100, bottom view 104 of pallet 100, side view 106 of pallet 100 and end view 108 of pallet 100.

Figure 1B:
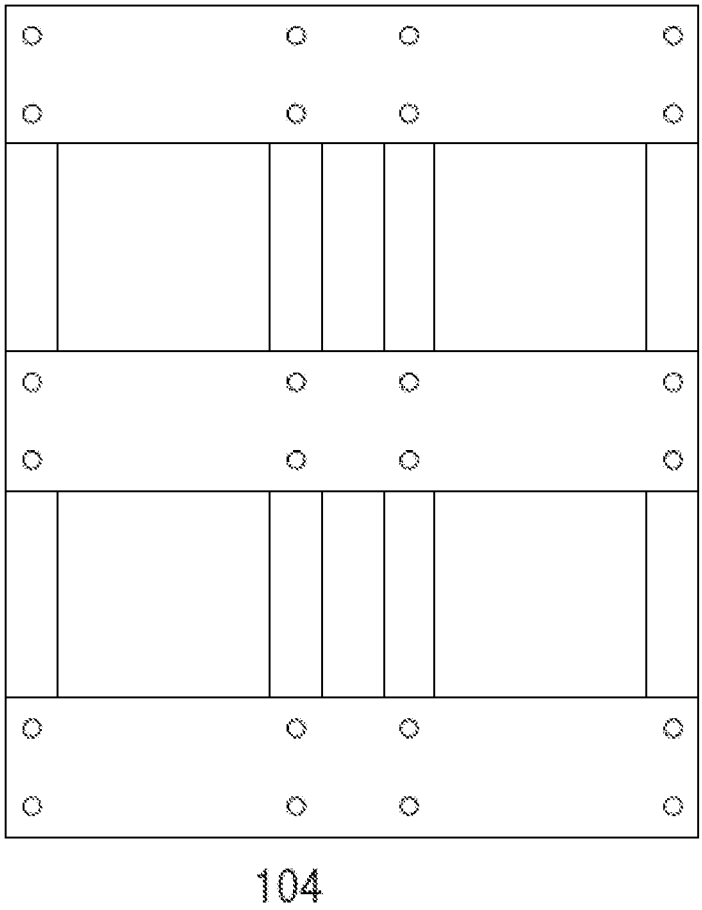
FIG. 1B depicts the bottom view of the plank and stringer pallet of FIG. 1 in accordance with an embodiment of the present disclosure.

FIG. 1B depicts the bottom view of the plank and stringer pallet of FIG. 1A in accordance with an embodiment of the present disclosure. The bottom view 104 depicts the stringer and plank relation shown in the top view of FIG. 1A.

Figure 2:
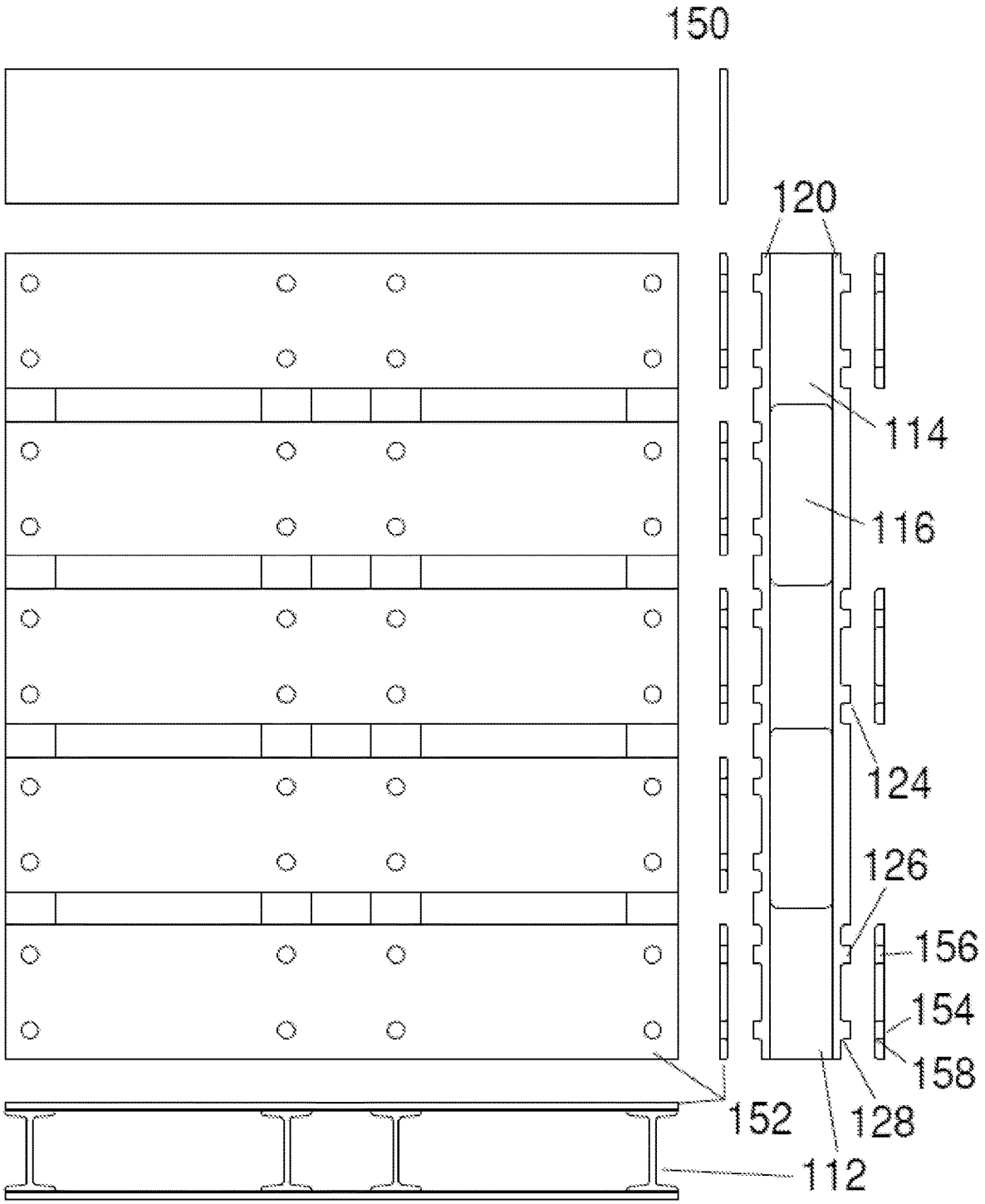
FIG. 2 depicts stringer blanks and plank blanks machined before assembly into a complete pallet in accordance with an embodiment of the present disclosure.

FIG. 2 depicts stringer blanks 110 and plank blanks 150 machined before assembly into a complete pallet 100 in accordance with an embodiment of the present disclosure. Each of the machined stringers 112 has unique machining that removes material for receiving machined planks 152 in a complementary and flush fitting relationship. FIG. 2 also illustrates a four-way pallet with four (4) I-Beam profile stringers 112 and eight (8) flat planks 152. When assembled, the top-most and bottom-most flange surfaces of stringers 112 are flush with the outside surfaces of planks 152. The top and bottom flanges 120 of stringers 112 have been machined to receive the full thickness of planks 152 in a flush fitting relationship. Each machined location on stringer 112 that accepts a flush fitting plank 152 has at least one post or plug 124 for accepting the corresponding, reciprocal machined hole or receptacle 154 located in plank 152. Stringers 112 would also have holes 116 machined through the web 114 to allow for full four-way utilization of the pallet by forklifts and pallet jacks.

The posts 124 are illustrated to be cylindrical 126 in shape with a positive chamfer 128 at its base. The receptacle 154 are illustrated to be cylindrical 156 in shape with a negative chamfer 158 at the edge. The flush engagement between a full compliment of machined stringers 112 and posts 124 with machined planks 152 and receptacles 154 results in a self-aligning, robust structural assembly. Truncated cones and other shapes could be used to accomplish the same self-aligning assembly of the complete pallet 100.

Screw type fasteners would be one method of affixing planks 152 to stringers 112 into a complete assembly 100. Screw type fasteners would allow repair of the pallet 100 and return to full and complete function. Flush fitting counter-sink type screws are anticipated for use in assembly.

A friction surface pattern 170, such as relieved circles, is molded or machined into the outside surface of planks 150 (not depicted). Other patterns could be employed as well. Also anticipated in this disclosure is the addition of full-length axial reinforcing fibers 180 located between receptacles 154. The fibers, parallel to the major axis, could also be located fully across the width of planks 150. These reinforcing fibers could be recessed into and below the surface of planks 150 during the molding process.

Extruding blank planks 150 and stringers 110 is not a limitation. Injection molding of finished planks 152 and stringers 112, which would eliminate the machining of blank extruded planks 150 and stringers 110, is a viable alternative manufacturing method and anticipated in this disclosure.

Figure 3A:
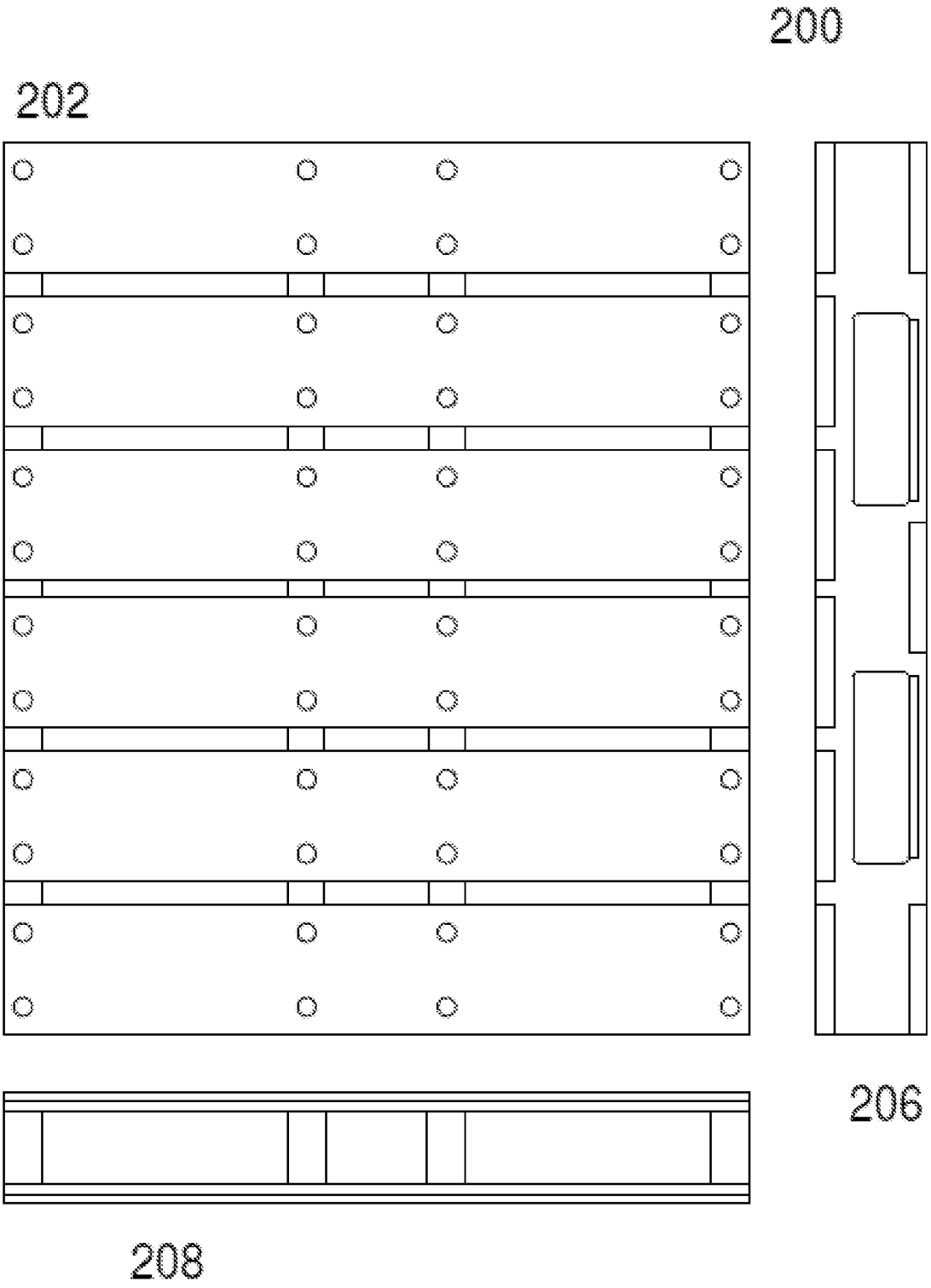
FIG. 3A depicts the plank and stringer pallet utilizing a polymer foam material extruded into separate stringer blanks and plank blanks in accordance with an embodiment of the present disclosure.

FIG. 3A depicts the plank and stringer pallet 200 utilizing a polymer foam material extruded into separate stringer blanks 210 and plank blanks 250 in accordance with an embodiment of the present disclosure. Seen in FIG. 3 are the top view 202 of pallet 200, bottom view 204 of pallet 200, side view 206 of pallet 200 and end view 208 of pallet 100. Extruded plank blanks 250 and stringer blanks 210 resemble the common profiles of solid wood lumber.

Figure 3B:
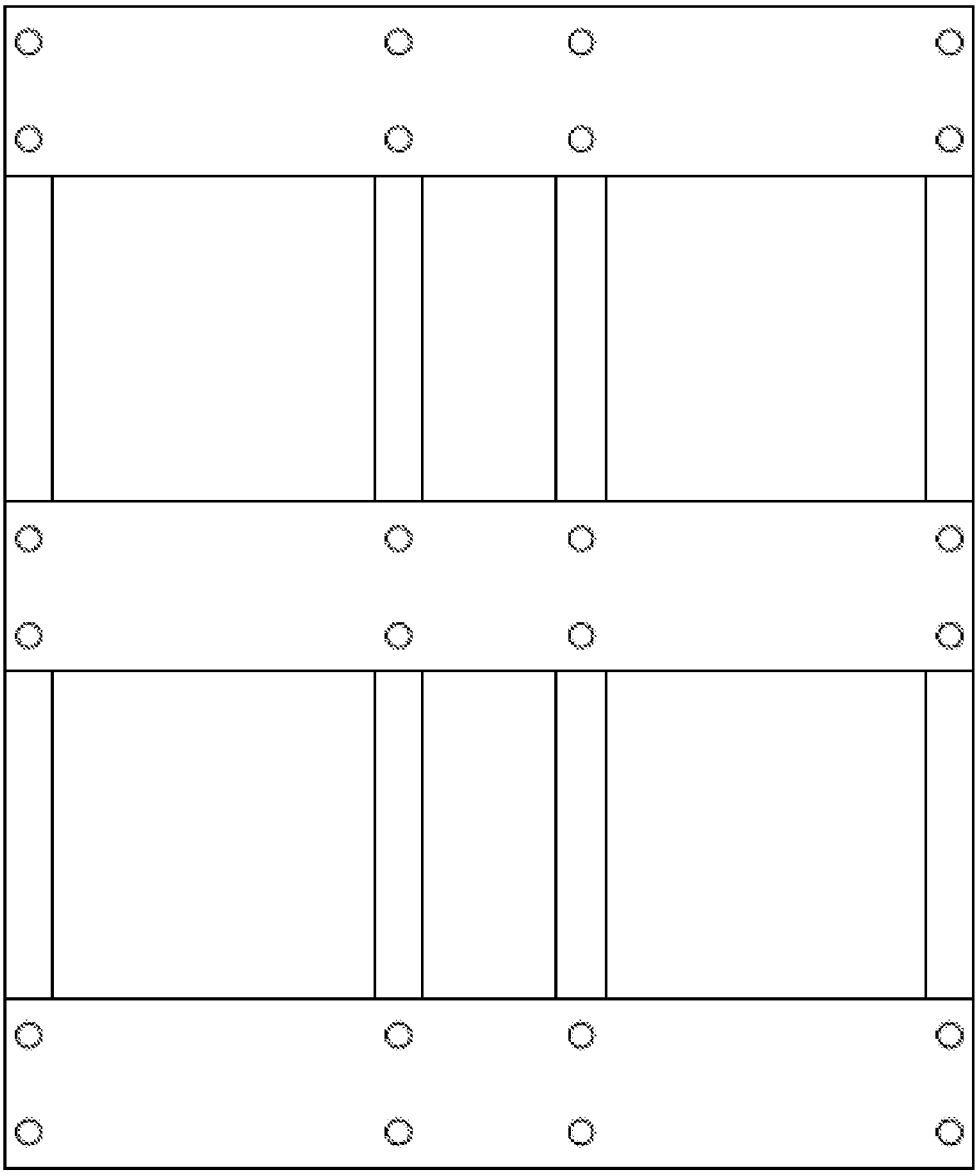
FIG. 3B depicts the bottom view of the plank and stringer pallet of FIG. 3A in accordance with an embodiment of the present disclosure.

FIG. 3B depicts the bottom view of the plank and stringer pallet of FIG. 3A in accordance with an embodiment of the present disclosure. The bottom view 204 depicts the stringer and plank relation shown in the top view of FIG. 3A.

The polymer foam material in pallet 200 is homogenous, cellular in structure and without the grain structure of wood, eliminating the structural weakness of wood members that can fail at the growth rings or grain structure. This polymer foam would typically have a density much less than wood.

Figure 4A:
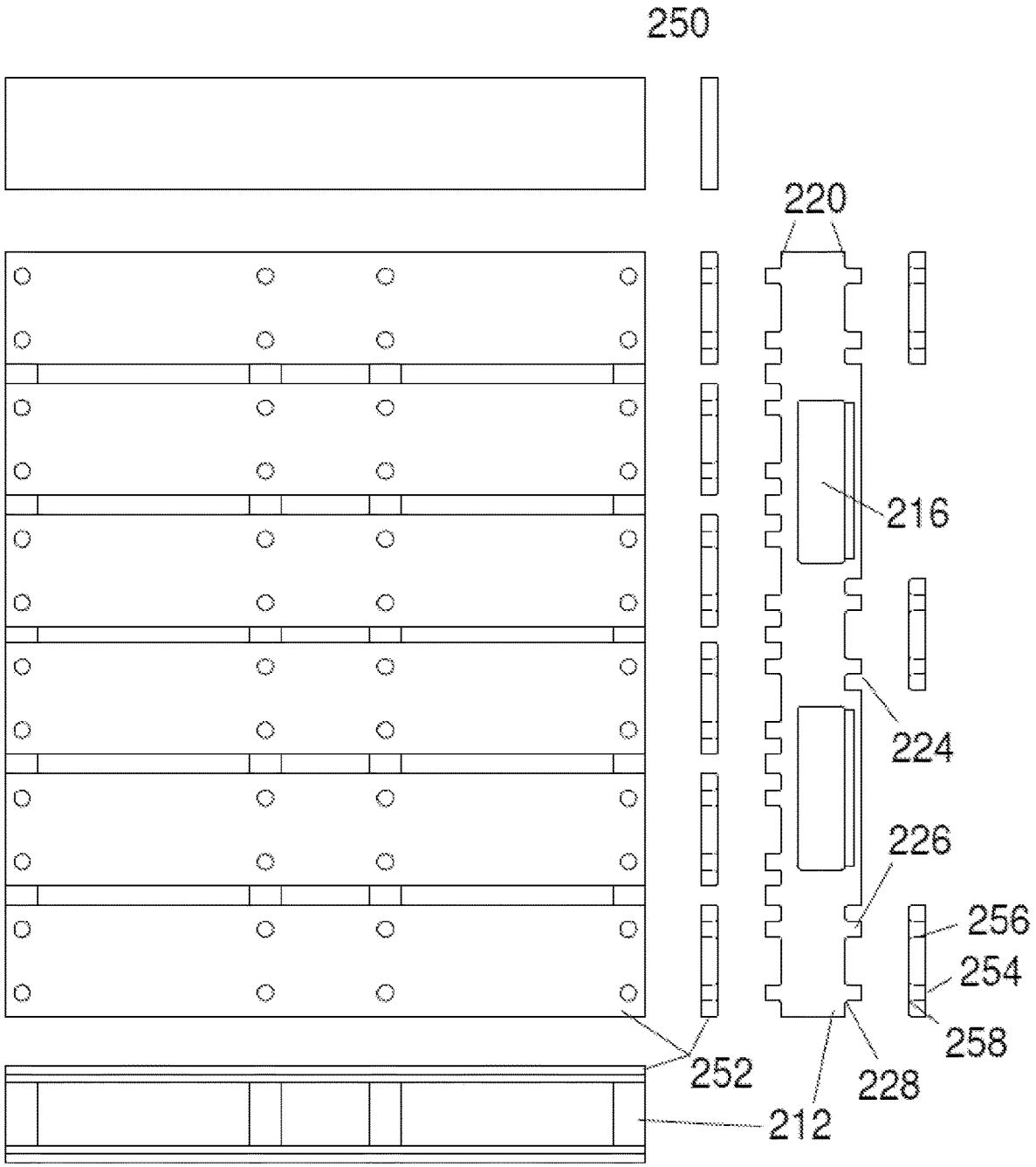
FIG. 4A depicts stringer blank and plank blank machined before assembly into a complete pallet in accordance with an embodiment of the present disclosure.

FIG. 4A depicts stringer blank 210 and plank blank 250 machined before assembly into a complete pallet 200 in accordance with an embodiment of the present disclosure. Each of the machined stringers 212 has unique machining that removes material for receiving the machined planks 252 in a complimentary and flush fitting relationship. FIG. 4A illustrates a four-way pallet with four (4) rectangular profile stringers 212 and nine (9) flat rectangular shaped planks (252). The top-most and bottom-most edge surfaces of stringers 212 are flush with the outside surfaces of planks 252 when assembled. Stringers 212 have been machined to receive the full thickness of planks 252 in a flush fitting relationship. Each location on stringers 212 that accept a flush fitting plank 252 have at least one post or plug 224 for accepting the corresponding and reciprocal machined holes or receptacles 264 located on planks 252. Stringers 212 have holes 216 machined through the web to allow for full four-way utilization of the pallet by forklifts and pallet jacks.

The posts 224 are illustrated to be cylindrical 226 in shape with a positive chamfer 228 at its base. The receptacles 254 are illustrated to be nominal cylindrical 256 in shape with a negative chamfer 258 at the edge. The flush engagement between a full complement of machined stringers 212 and posts 224 with machined planks 252 and receptacles 254 results in a self-aligning, robust structural assembly. Truncated cones and other shapes are used to accomplish the same self-aligning assembly of the pallet 200.

Screw type fasteners are one method of affixing planks 252 to stringers 212 into a complete assembly 200. Screw type fasteners allow repair of the pallet 200 and return to full and complete function. Flush fitting counter-sink head screws are anticipated for use in assembly.

Figure 4B:
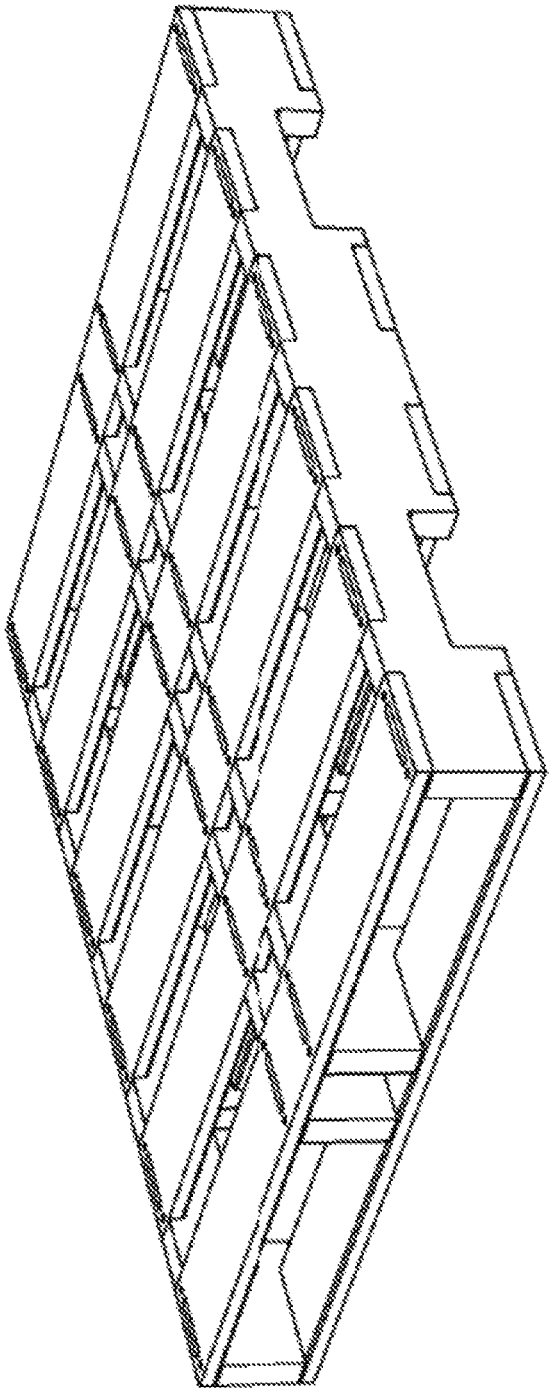
FIG. 4B depicts an assembled, perspective view of a slightly different execution of pallet 200 in accordance with an embodiment of the present disclosure.

FIG. 4B depicts an assembled, perspective view of a slightly different execution of pallet 200 in accordance with an embodiment of the present disclosure. It uses obround posts and receptacles in lieu of cylindrical posts and circular receptacles. Cut outs along the side of the stringers for receiving the forks lifts or pallet jacks are relieved completely and open to the bottom surface. There are 6 planks on the upper surface and four planks on the bottom surface. The number of planks on the top or bottom is not a limitation.

Figure 4C:
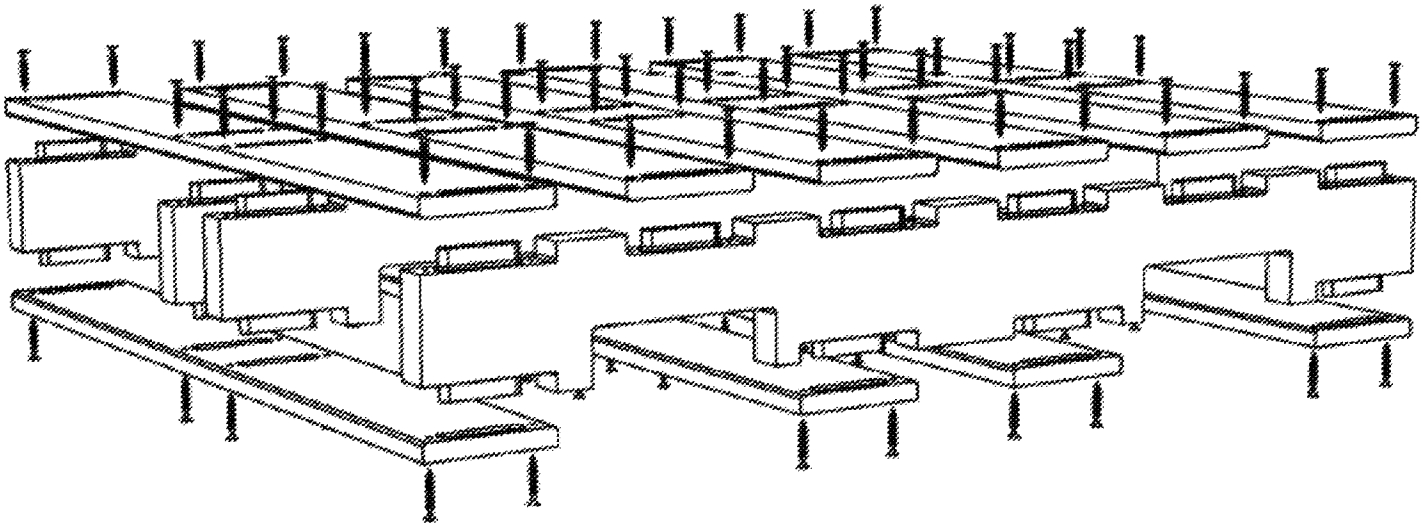
FIG. 4C depicts an exploded view of the assembled pallet seen in FIG. 4A in accordance with an embodiment of the present disclosure.

FIG. 4C depicts an exploded view of the assembled pallet 200 seen in FIG. 4A in accordance with an embodiment of the present disclosure. The upper six planks and affixing screws are seen removed and above the four stringers. The lower four planks and affixing screws are seen removed and below the four stringers. Obround posts on the upper and lower edges of the stringers, which are received into obround receptacles in the planks, can be readily seen as different than the pairs of cylindrical posts and circular receptacles illustrated and described in FIGS. 1, 2, 3 and 4.

Figure 5:
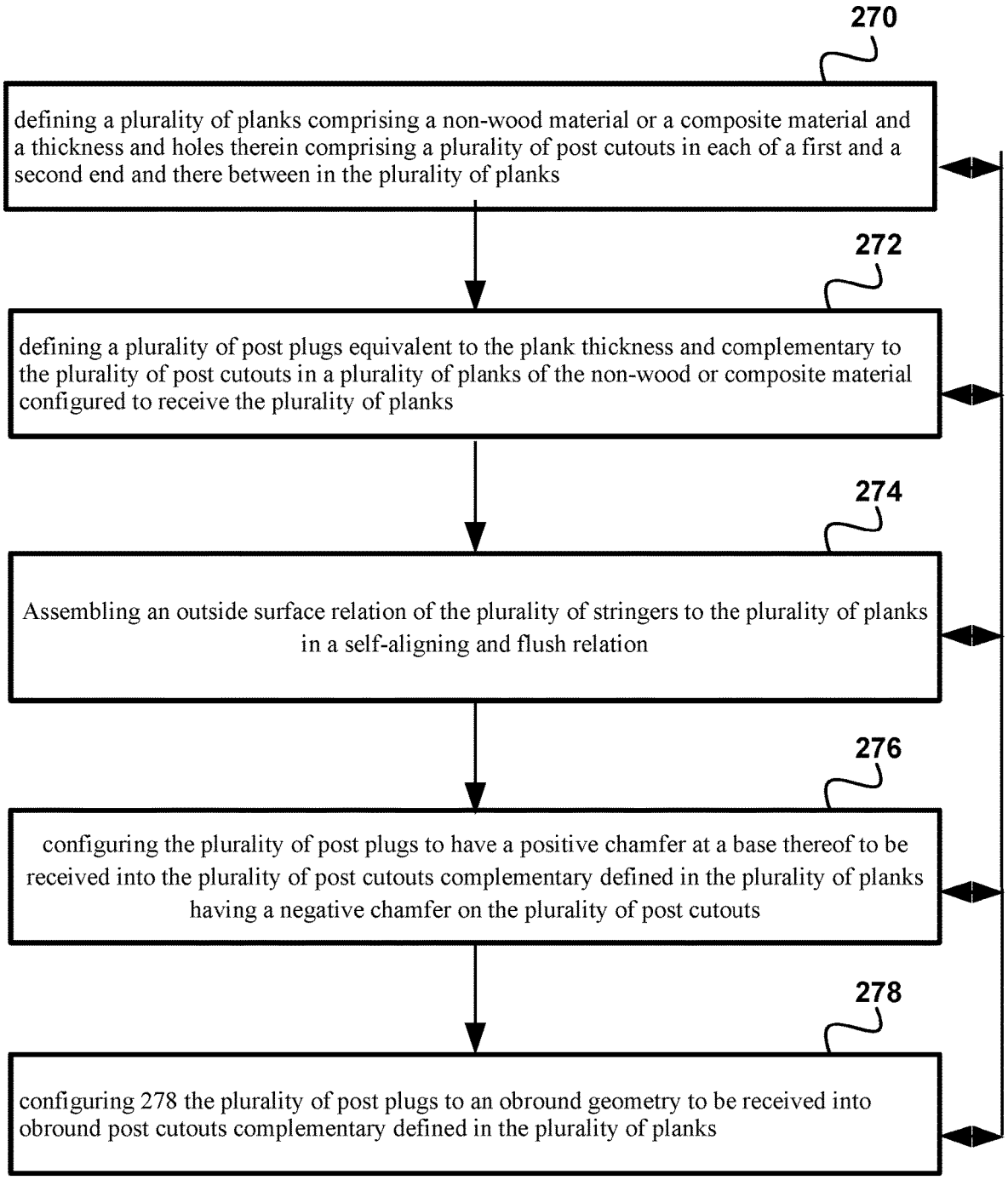
FIG. 5 is a flow chart of a method of making the posted composite stringer and plank pallet in accordance with an embodiment of the present disclosure.

FIG. 5 is a flow chart of a method of making the posted composite stringer and plank pallet in accordance with an embodiment of the present disclosure. The method of making the disclosed pallet includes defining 270 a plurality of planks comprising a composite material and a thickness and holes therein comprising a plurality of post cutouts in each of a first and a second end of the plurality of planks. The disclosed method also includes defining 272 a plurality of post plugs equivalent to the plank thickness and complementary to the plurality of post cutouts in a plurality of planks of a composite material configured to receive the plurality of planks. Assembling 274 an outside surface relation of the plurality of stringers to the plurality of planks in a self-aligning and flush relation.

Further embodiments of the disclosed method include configuring 276 the plurality of post plugs to have a positive chamfer at a base thereof to be received into the plurality of post cutouts complementary defined in the plurality of planks having a negative chamfer on the plurality of post cutouts. The embodied methods also include configuring 278 the plurality of post plugs to an obround geometry to be received into obround post cutouts complementary defined in the plurality of planks.

Figure 6:
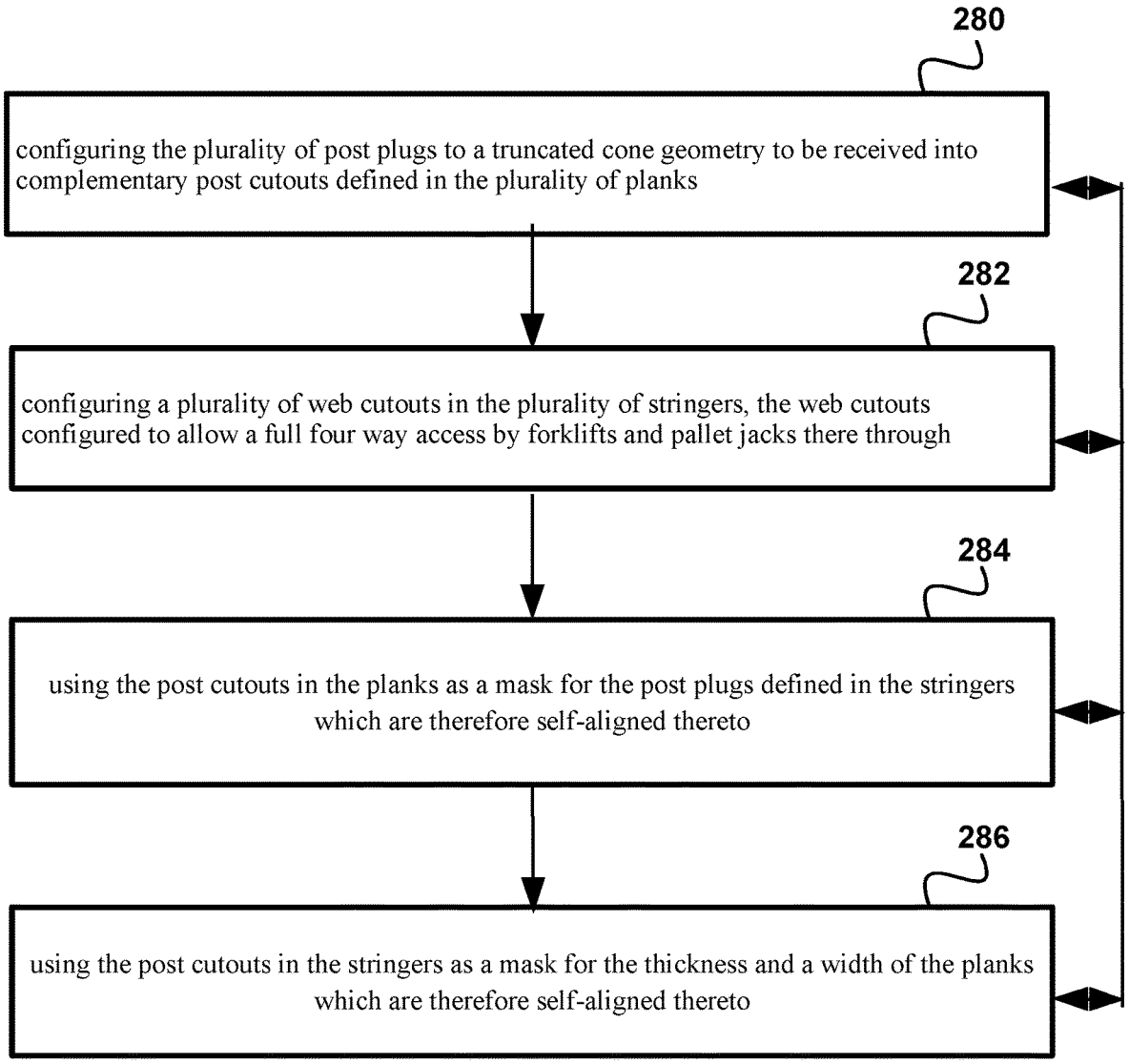
FIG. 6 is another flow chart of a method of making the posted composite stringer and plank pallet in accordance with an embodiment of the present disclosure.

FIG. 6 is another flow chart of a method of making the posted composite stringer and plank pallet in accordance with an embodiment of the present disclosure. The other method additionally includes configuring 280 the plurality of post plugs to a truncated cone geometry to be received into complementary post cutouts defined in the plurality of planks. The other method further includes configuring 282 a plurality of web cutouts in the plurality of stringers, the web cutouts configured to allow a full four way access by forklifts and pallet jacks there through. The other method yet includes using 284 the post cutouts in the planks as a mask for the post plugs defined in the stringers which are therefore self-aligned thereto. The other method still includes using 286 the post cutouts in the stringers as a mask for the thickness and a width of the planks which are therefore self-aligned thereto.

Figure 7:
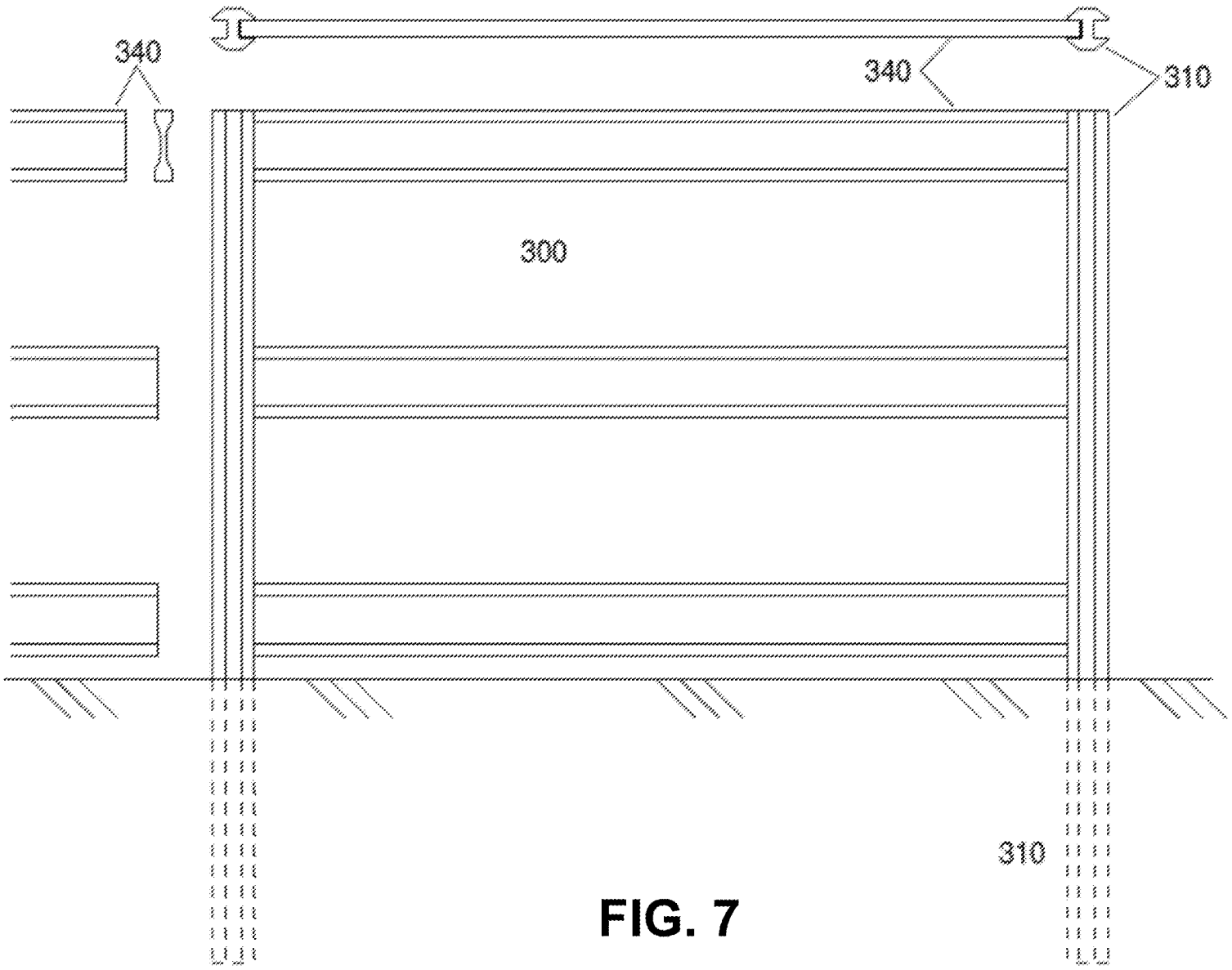
FIG. 7 depicts an example of a WLRT fence post and fence plank system utilizing a urethane and mineral filler composite cast or extruded into fence posts and fence planks in accordance with an embodiment of the disclosure.

FIG. 7 depicts another example of a WLRT in a unique fence post and fence plank system 300 utilizing a urethane and mineral filler composite cast or extruded into fence posts 310 and fence planks 340 in accordance with an embodiment of the disclosure. The WLRT engineered non-wood posts 310 and fence planks 340 allow for shapes, sizes and material properties to be optimized for the application. The composite material used is homogenous, amorphous and without the grain structure of wood, thus eliminating the structural weakness of wood members that commonly fail at the growth rings or grain structure. The composite material can be foamed to reduce density to that of wood or less and can include reinforcement materials such as fiberglass and others.

Figure 8:
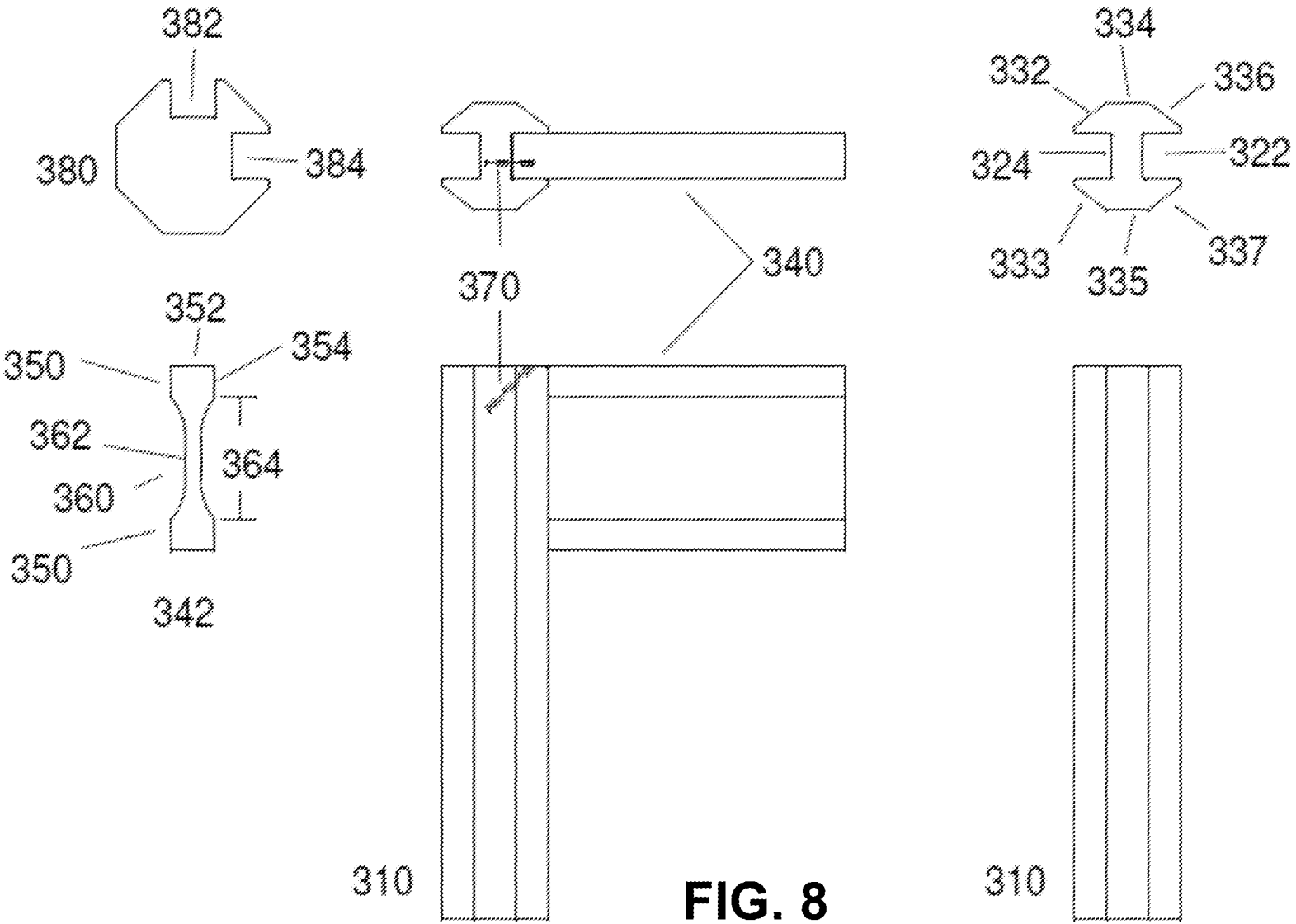
FIG. 8 depicts a fence post with full length opposing slots parallel to the major axis and full length opposing angled surfaces likewise parallel to the major axis in accordance with an embodiment of the present disclosure

FIG. 8 depicts fence post 310 with full length opposing slots 322 and 324 parallel to the major axis and full length opposing angled surfaces 332, 334, 336 and 333, 335, 337 likewise parallel to the major axis in accordance with an embodiment of the present disclosure. Unique cross section of post 310 minimizes cross sectional area while providing sufficient bending strength in all directions perpendicular to the major axis of post 310. Adding full length axial reinforcing fibers embedded in angled faces 332, 336, 333 and 337 increases bending strength at all directions perpendicular to the centerline, major axis of post 310.

An end view of fence plank 342 illustrates end nodes 350. The width 352 of a single end node 350 is at least twice the minimum thickness 362 of web portion 360. The height 354 of a single end node 350 is equal to or less than the height 364 of web portion 360.

Installed fence system 300 typically includes consecutive posts 310 spaced a certain distance apart and inserted into the ground. Slot 322 of a first post 310 faces slot 324 of a second post 310 and likewise. Fence planks 340 span the distance between the interior vertical surface of slot 322 of a first post and the interior vertical surface of slot 324 of a second fence post. Fence planks 340 are affixed by angled pilot drilling and screwing 370 through the upper or lower nodes 350 into the web 323 between slot 322 and 324 of posts 310, resulting in a 'blind' mounting of planks 340 to posts 310 without any added brackets, braces, ledges or external pieces to vertically support and affix planks 340 to posts 310.

Different fence configurations or styles are accomplished with this system such as three horizontal plank 340 'horse fencing' or vertically stacked on edge planks 340 for privacy fencing. Exterior faces 334 and 335 of fence post 310 can be used for nailing or stapling wire fencing to post 310.

FIG. 8 also illustrates a different version post 380 with slot 382 and slot 384 at right angles to each other instead of being opposed. Post 380 could be employed as a corner post.

Figure 9A:
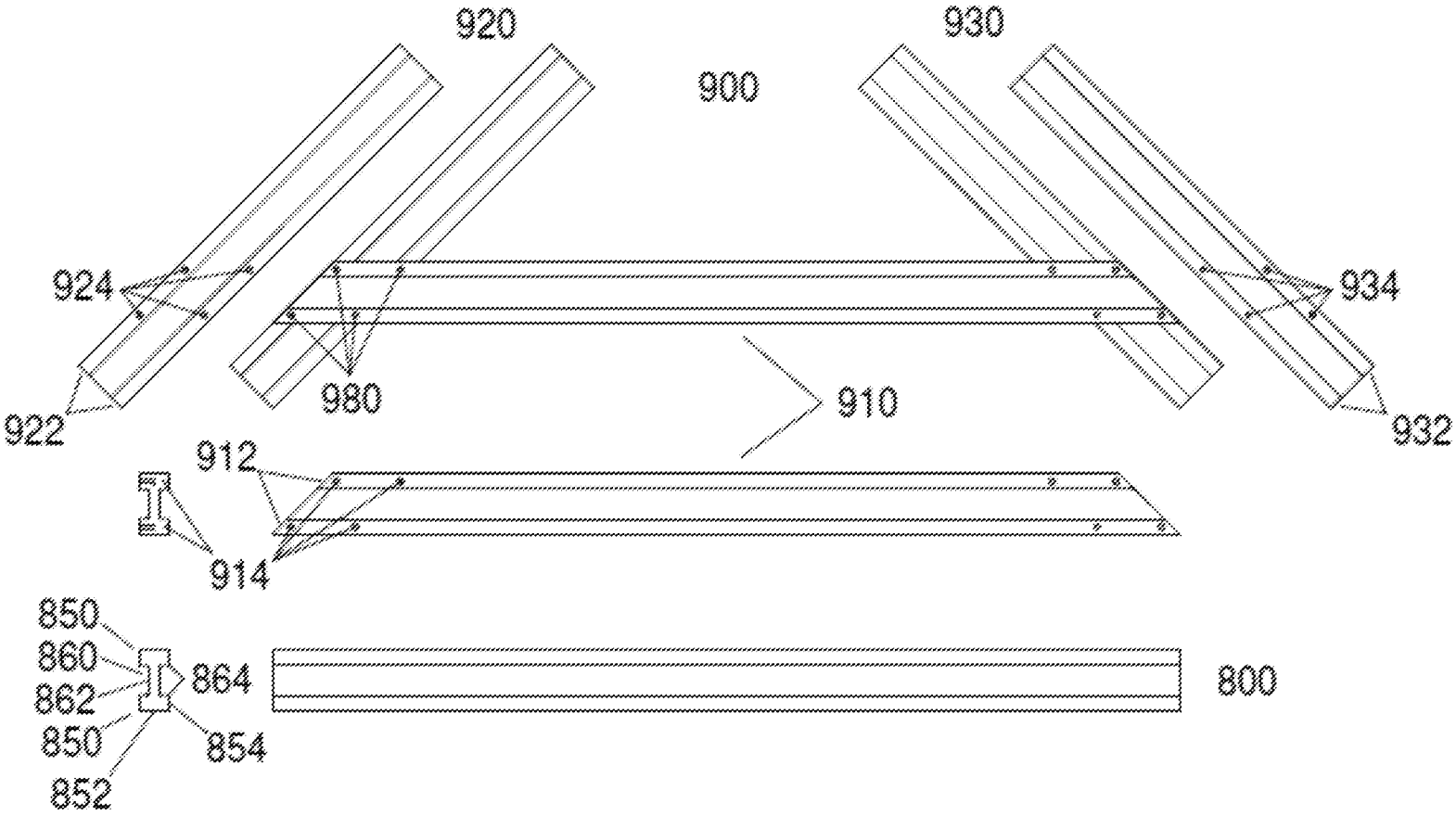
FIG. 9A depicts an example of WLRT structure in accordance with an embodiment of the present disclosure.

FIG. 9A depicts an example of Wood Lumber Replacement Technology structure in accordance with an embodiment of the disclosure. The alternative lumber profile 800 is in lieu of nominal or dimensional wood lumber of a rectangular cross section. Similar to the relationships described for fence plank 340, alternative profile 800 has end nodes 850. Node width 852 is at least twice the minimum thickness 862 of web portion 860. The height 854 of a single end node 850 is equal to or less than height 864 of web portion 860.

The truss assembly 900 uses alternative profile 800 lumber replacement members. Different than nails or nail plate assembly, the various members 910, 920 and 930 of truss assembly 900 use through bolt assembly 980 to complete the truss. Bolting through the locations of overlapping, connecting holes 914 in nodes 912 of horizontal member 910 and overlapping, connecting holes 924 in nodes 922 of left member 920 with overlapping, connecting holes 934 in nodes 932 of right member 930 self-align and position the different members in the truss assembly 900. CNC machining, cutting to length and drilling holes in the nodes of members 910, 920 ad 930 generate accurate truss assemblies without the need for framing tables to physically position and abut various wood lumber members for assembly into a complete truss with pneumatically pressed nail plates and the like.

Use of profile lumber 800 members that are precision cut to length with precision hole locations in the end nodes are used in different assembled members like ceiling joists, floor joists, deck joists and others are anticipated in this disclosure.

Figure 9B:
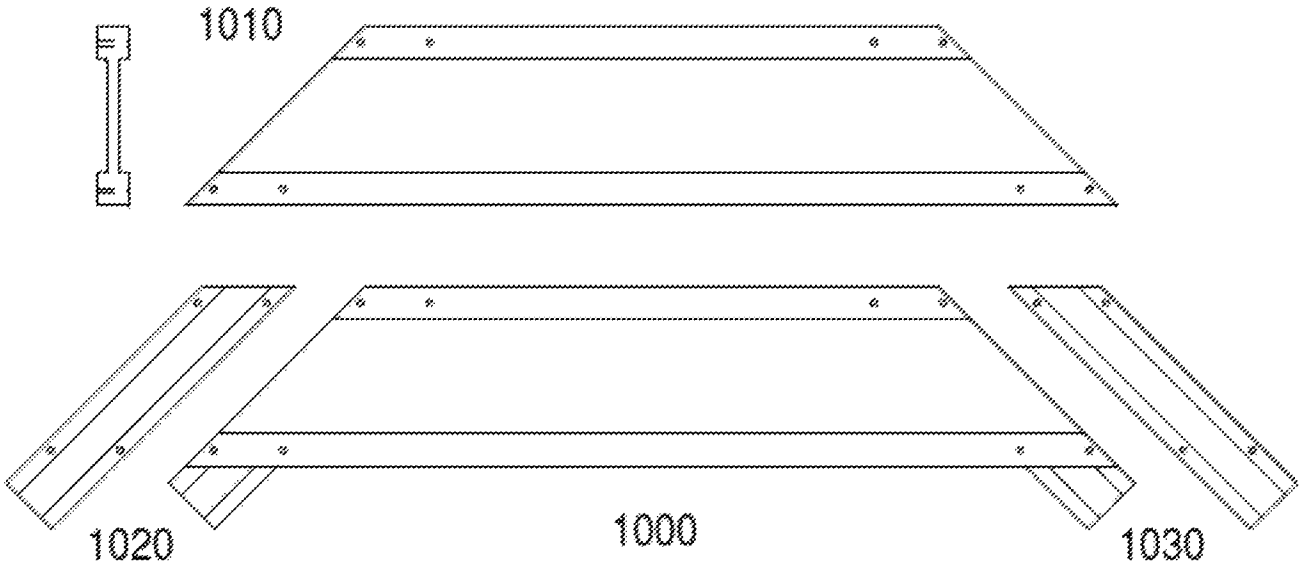
FIG. 9B depicts an alternative truss assembly comprised of members bolted together in a similar manner as assembly of FIG. 9A in accordance with an embodiment of the present disclosure.

FIG. 9B depicts an alternative truss assembly 1000 comprised of members 1010, 1020 and 1030 bolted together in a similar manner as assembly 900 FIG. 9A in accordance with an embodiment of the present disclosure. Horizontal member 1010 in truss assembly 1000 has a greater depth of section than horizontal member 910 in assembly 900.

Although the components herein are shown and described in a particular order, the order thereof may be altered so that certain advantages or characteristics may be optimized. In another embodiment, instructions or sub-operations of distinct steps may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A stringer and plank pallet comprising:

a plurality of planks comprising a top side and a bottom side and a composite or a non-wood material and a thickness and holes defined therein comprising a plurality of post cutouts in each of a first and a second end and there between in the plurality of planks; and a plurality of stringers comprising the composite or non-wood material configured to receive the bottom side of the plurality of planks on a top side of the plurality of stringers via a plurality of post plugs equivalent to the plank thickness and complementary to the plurality of post cutouts, wherein an assembled outside surface relation of the top side of the plurality of stringers between the top side of the plurality of planks is continuous, self-aligning and flush thereto.

2. The pallet of claim 1, wherein the plurality of post plugs are configured to have a positive chamfer at a base thereof to be received into the plurality of post cutouts complementary defined in the plurality of planks having a negative chamfer on the plurality of post cutouts.

3. The pallet of claim 1, wherein the plurality of post plugs comprise truncated cones configured to be received into complementary post cutouts defined in the plurality of planks.

4. The pallet of claim 1, further comprising a plurality of web cutouts in the plurality of stringers, the web cutouts configured to allow a full four way access by forklifts and pallet jacks there through.

5. The pallet of claim 1, further comprising a plurality of holes defined in the plurality of planks adjacent the post cutouts for a plurality of fasteners driven into the plurality of stringers.

6. A stringer and plank pallet system comprising:

a plurality of planks comprising a top side and a bottom side and a composite or a non-wood material and a thickness and holes defined therein comprising a plurality of post cutouts in each of a first and a second end and there between in the plurality of planks;

a plurality of stringers comprising the composite or non-wood material configured to receive the bottom side of the plurality of planks on a top side of the plurality of stringers via a plurality of post plugs equivalent to the plank thickness and complementary to the plurality of post cutouts, wherein an assembled outside surface relation of the top side of the plurality of stringers between the top side of the plurality of planks is continuous, self-aligning and flush; and a plurality of holes in the planks adjacent the post cutouts for a plurality of fasteners driven into the plurality of stringers.

7. The pallet system of claim 6, wherein the plurality of holes in the planks comprise a mask for a fastening of the plurality of planks to the plurality of stringers via the plurality of fasteners.

8. The pallet system of claim 1, wherein all stringers are configured with a pair of web cutouts for a pallet jack and a forklift access.

9. A method of making a pallet, the method comprising:

defining a plurality of planks comprising a top side and a bottom side and comprising a composite or a non-wood material and a thickness and holes therein comprising a plurality of post cutouts in each of a first and a second end of the plurality of planks; and defining a plurality of post plugs equivalent to the plank thickness and complementary to the plurality of post cutouts in a plurality of planks of the composite or non-wood material configured to receive the bottom side of the plurality of planks on a top side of the plurality of stringers, wherein an assembled outside surface relation of the top side of the plurality of stringers between the top side of the plurality of planks is continuous, self-aligning and flush.

10. The method of claim 9, further comprising configuring the plurality of post plugs to have a positive chamfer at a base thereof to be received into the plurality of post cutouts complementary defined in the plurality of planks having a negative chamfer on the plurality of post cutouts.

11. The method of claim 9, further comprising configuring the plurality of post plugs to an obround geometry to be received into obround post cutouts complementary defined in the plurality of planks.

12. The method of claim 9, further comprising configuring the plurality of post plugs to a truncated cone geometry to be received into complementary post cutouts defined in the plurality of planks.

13. The method of claim 9, further comprising configuring a plurality of web cutouts in the plurality of stringers, the web cutouts configured to allow a full four way access by forklifts and pallet jacks there through.

14. The method of claim 9, further comprising using the post cutouts in the planks as a mask for the post plugs defined in the stringers which are therefore self-aligned thereto.

15. The method of claim 9, further comprising using the post cutouts in the stringers as a mask for the thickness and a width of the planks which are therefore self-aligned thereto.

* * * * *